US005293803A

United States Patent [19]

Foster

[11] Patent Number: 5,293,803

[45] Date of Patent: Mar. 15, 1994

[54] CUTTING ASSEMBLY

[75] Inventor: Clyde E. Foster, Pasco, Wash.

[73] Assignee: Universal Frozen Foods Co., Twin Falls, Id.

[21] Appl. No.: 884,271

[22] Filed: May 12, 1992

Related U.S. Application Data

[63] Continuation of Ser. No. 682,653, Apr. 9, 1991, abandoned.

[51] Int. Cl.[5] ..... B26D 3/11

[52] U.S. Cl. ..... 83/865; 83/356.3; 83/672; 83/932; 99/538

[58] Field of Search ..... 99/538; 83/875, 861, 83/932, 356.2, 592, 672, 417; 241/92, 257 R, 257.1

[56] References Cited

U.S. PATENT DOCUMENTS

| | | | |
|---|---|---|---|
| 97,047 | 11/1969 | Chrysler . | |
| 101,520 | 4/1970 | Schaub . | |
| 417,744 | 12/1889 | Ross | 83/672 |
| 497,675 | 5/1983 | Miller . | |
| 1,534,078 | 4/1925 | Ruffner . | |
| 1,909,029 | 5/1933 | Walter | 83/672 X |
| 2,017,559 | 10/1935 | Wolfinger . | |
| 2,464,993 | 3/1949 | Ross . | |
| 2,610,664 | 9/1952 | Thompson . | |
| 2,652,871 | 9/1953 | Botley et al. | 83/672 X |
| 3,057,386 | 10/1962 | Massaro . | |
| 3,217,768 | 11/1965 | Lamb . | |
| 3,746,062 | 7/1973 | Nystrom et al. | 241/92 X |
| 3,869,773 | 3/1975 | Gineiding | 241/92 X |
| 3,952,621 | 4/1976 | Chambos | 83/733 |
| 4,053,004 | 10/1977 | Barwise et al. | 83/672 X |
| 4,171,103 | 10/1979 | Rossler | 241/257 RX |
| 4,198,887 | 4/1980 | Williams, Jr. | 83/356.3 |
| 4,228,963 | 10/1980 | Yamauchi et al. | 241/92 |
| 4,256,265 | 3/1981 | Madan | 241/92 |
| 4,367,667 | 1/1983 | Shibata | 241/92 X |
| 4,387,111 | 6/1983 | Mullender | 426/615 |
| 4,393,737 | 7/1983 | Shibata | 83/356.3 |
| 4,644,838 | 2/1987 | Samson et al. | 83/865 |
| 4,926,726 | 5/1990 | Julian | 83/356.3 X |
| 4,979,418 | 12/1990 | Covert et al. | 83/865 |

*Primary Examiner*—Rinaldi Rada
*Attorney, Agent, or Firm*—Foley & Lardner

[57] ABSTRACT

A blade assembly for cutting vegetables, such as potatoes, preparatory to processing into a plurality of helical strips. The assembly includes a vertically disposed central cutting tube, a base plate and a plurality of tiers disposed therebetween. The tiers preferably are helically disposed with respect to the cutting tube and base plate. The blade assembly may be utilized in a cutting assembly for cutting articles into helical strips having a holder with at least one longitudinal passage therein, a plurality of inwardly biased members extendable in the passage to align and hold the article against rotation while being cut, and a rotary cutter which includes the blade assembly.

16 Claims, 4 Drawing Sheets

CUTTING ASSEMBLY

This is a continuation of application Ser. No. 07/682,853 filed Apr. 9, 1991 abandoned.

FIELD OF THE INVENTION

The present invention relates to the cutting of vegetables, and in its preferred embodiment to a novel tool for cutting potatoes into a plurality of helical strips.

BACKGROUND OF THE INVENTION

Raw potatoes and other vegetables have long been cut into various sized pieces for cooking or processing by a variety of methods and machines. Early examples include, U.S. Pat. Nos. 97,047, issued Nov. 23, 1869 to Chrysler (device for cutting vegetables into narrow strips or slices); U.S. Pat. No. 101,520, issued Apr. 5, 1870 to Schaub (improvement in cabbage cutter); U.S. Pat. No. 497,675, issued May 16, 1983 to Miller (fruit or vegetable cutter); U.S. Pat. No. 1,534,078, issued Apr. 21, 1985 to Ruffner (vegetable slicing machine); and U.S. Pat. No. 2,017,559, issued Oct. 15, 1935 to Wolfinger (beet slicer).

A number of cutting tools and methods are also known for slicing or otherwise cutting potatoes. See, e.g., U.S. Pat. Nos. 2,464,993, issued Mar. 22, 1949 to Ross; U.S. Pat. No. 2,610,664, issued Sep. 16, 1952 to Thompson; U.S. Pat. No. 3,057,386, issued Oct. 9, 1962 to Massaro; U.S. Pat. No. 3,217,768, issued Nov. 16, 1965 to Lamb; U.S. Pat. No. 3,952,621, issued Apr. 27, 1976 to Chambos; and U.S. Pat. No. 4,387,111, issued Jun. 7, 1983 to Müllender.

One known method of cutting potatoes into a plurality of helical strips involves rotating a potato against a fixed blade cutter. The device includes a cutting plate having a pivot pin for engaging one end of a potato. The other end of the potato is engaged by a toothed drive disk which is mounted opposite the plate on a crank driven shaft. A set of slitting knives protrude from the surface of the cutting plate and a cutting knife is mounted to the cutting plate adjacent the pivot pin. The blade of this knife extends radially from the pivot pin in a plane parallel to the surface of the cutting plate. These knives cut the potato into a plurality of helical strips as it is rotated against the cutting plate.

Although this device produces helically-cut potato strips, it suffers from several problems. First, since the potato is rotated against the cutting plate, a center core of the potato is progressively crushed against the plate resulting in waste and degradation of the product. The toothed drive disk also causes further waste since the potato cannot be cut into helical strips from end to end without interference between the teeth of the drive disk and the cutting knives. The speed of operation of this device is further limited by the time required to load a potato into axial alignment with the pivot pin and drive disk and by the limitations on rotational speed of the crank.

Further discussion of the history and operation of such cutting devices can be found in U.S. Pat. No. 4,644,838 entitled "Apparatus for Helical Cutting of Potatoes", issued to Samson et al. on Feb. 24, 1987 and assigned to Rogers Walla-Walla, Inc. (hereinafter the '838 patent). That patent discloses a method and apparatus for cutting articles such as potatoes into helical strips wherein the potato is held against rotation and aligned by a plurality of fingers and moved longitudinally against a rapidly rotating cutting head.

The particular cutter head disclosed in the '838 patent included a plurality of slitting knives which extend outward in a generally parallel alignment with the axis of rotation of the cutter head. The knives were positioned to form concentric longitudinal cuts in the potato. Helical strips are produced by a transverse blade, the cutting edge of which protrudes from the face of the cutter head as the cutter head is rotated against the potato. The cutter head may include a center pin for engaging the potato or, alternatively, could have included an upstanding cutting tube mounted at the rotational center of the cutting head. That tube is sharpened and cuts a cylinder of material from the center of the potato.

While operation of the cutting device of the '838 patent overcame many of the difficulties of prior art cutting devices and provided a method for rapidly cutting a potato into a plurality of helical strips without waste of a significant portion of the potato, there remains a need for a cutting head which would improve the efficiency of the cut. Moreover, while various cutting heads are known, such as those shown to be useful in food processors and the like (see, U.S. Pat. Nos. 4,393,737, issued Jul. 19, 1983 to Shibata and 4,228,963, issued Oct. 21, 1980 to Yamauchi), or those shown in the patents cited above, such known cutting heads fail to fully address the foregoing deficiencies.

SUMMARY OF THE INVENTION

The present invention features a tiered, cone-shaped blade which is useful in a variety of applications, such as for automatically cutting vegetables, such as potatoes, into elongated helical strips. The present invention, in its preferred embodiment, comprises a cutting assembly having a plurality of blades arranged in tiers. The blades are positioned to form concentric longitudinal cuts in the potato, such that helical strips are produced in an efficient and reproducible manner.

How the present invention provides these benefits will become apparent shortly as the preferred embodiment thereof is described in connection with the drawings. Generally, however, the benefits are provided by mounting a cutting assembly in an apparatus for helical cutting of potatoes. The cutting assembly may be utilized in the same manner as conventional cutter heads. When so used, improved cutting efficiency is obtained.

Other ways in which the benefits of the present invention can be embodied and modified by those skilled in the art for a variety of applications will be discussed in the following sections of this specification.

BRIEF DESCRIPTION OF THE DRAWINGS

A preferred exemplary embodiment of the present invention will hereinafter be described in conjunction with the appended drawings, wherein like designations denote like elements. Furthermore, scale is not employed in the drawings and some components of a typical cutting apparatus have been eliminated for purposes of showing with greater clarity those components which pertain to the present invention.

DESCRIPTION OF THE PREFERRED EMBODIMENT

The present invention will be described in this section of the specification as part of a cutting apparatus, but it should be appreciated that the novel features of the invention make the invention particularly suitable for use in many other types of devices and apparatus such as, but not limited to, machines for slicing, cutting or otherwise processing vegetables or other food stuffs, where the object to be cut is held against rotation and moved into engagement with a rotating cutting assembly.

Figure 1:
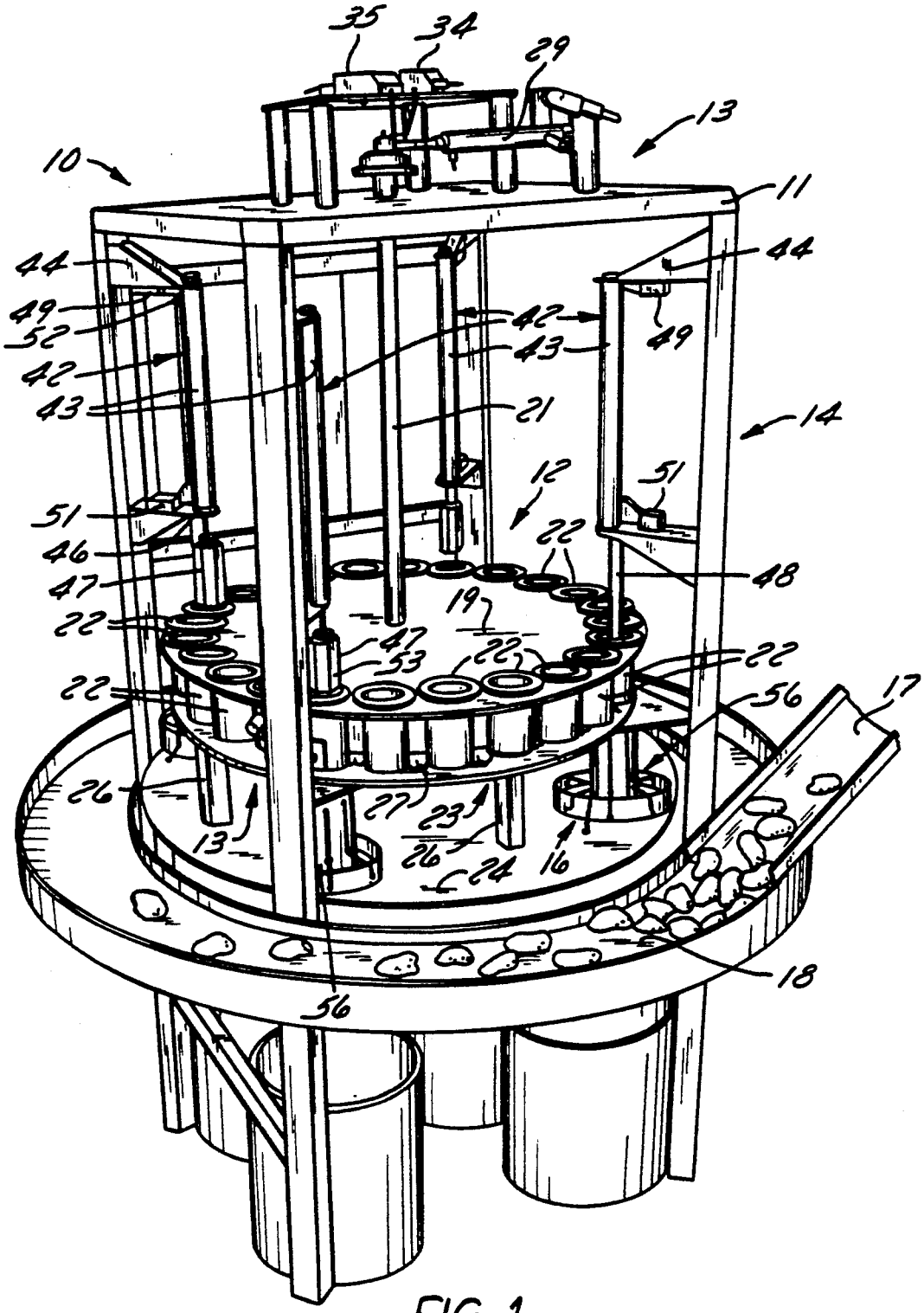
FIG. 1 is a perspective view of a cutting apparatus with which the cutting assembly according to the present invention may be employed.
Figure 2:
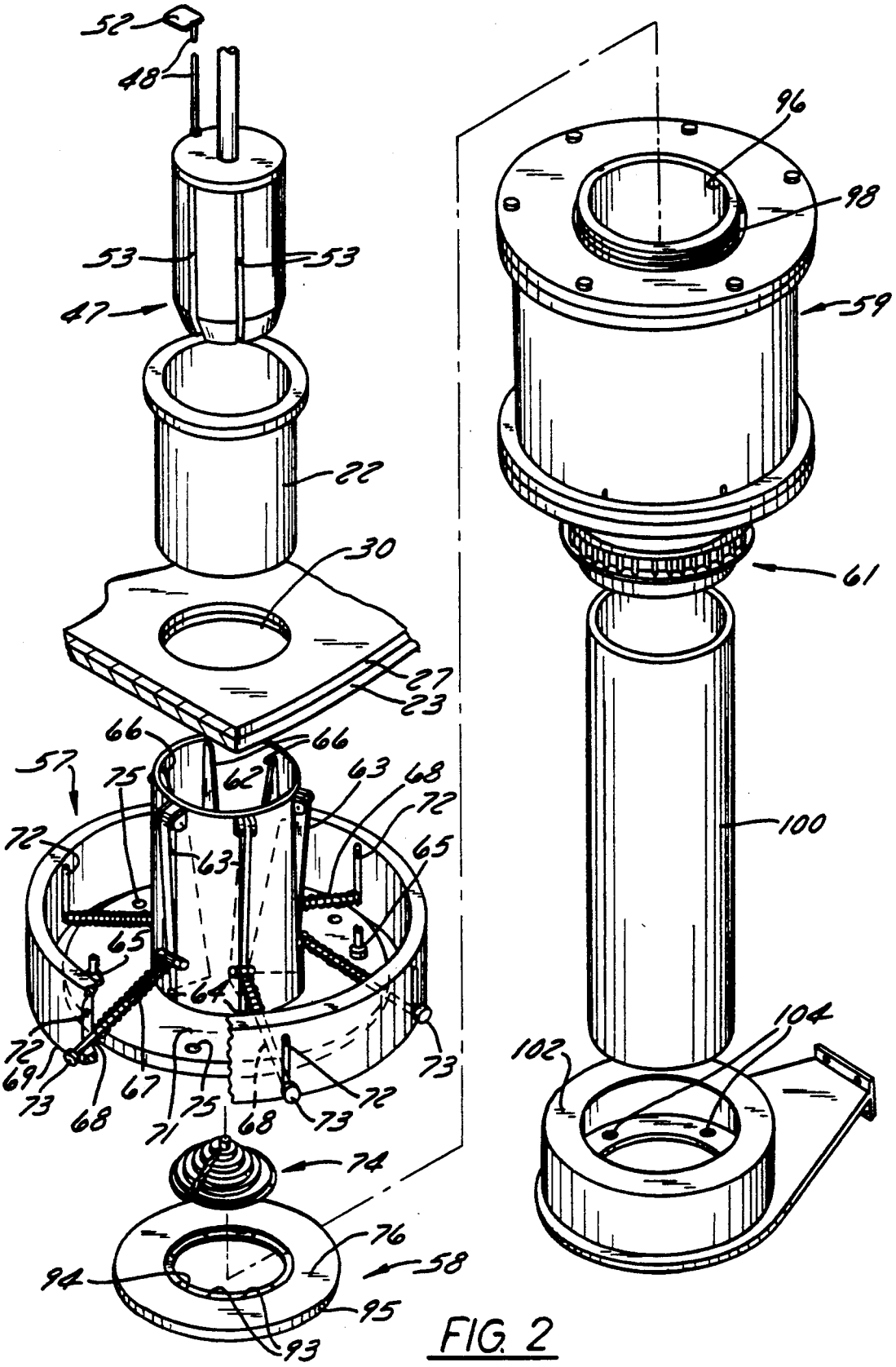
FIG. 2 is an exploded perspective view of the feeding, holding and cutting mechanisms of the cutting apparatus of FIG. 1 with parts broken away.

Before proceeding to a more detailed description of the preferred embodiment, it will be helpful to point out the basic elements of the present invention as incorporated in a cutting apparatus such as the one disclosed in the '838 patent. For this purpose, reference should first be made to the schematic diagrams shown in FIGS. 1 and 2, depicting a cutting apparatus 10. It should be understood at the outset, however, that the cutting apparatus could be widely varied and that the potato feeding and other components of the '838 patent could be changed without departing from the scope of this invention. The cutting assembly described in detail later could be used with any cutting apparatus in which the object is held against rotation and forced through a rotating cutting head.

As best shown in FIG. 1, this apparatus includes a frame 11 to which is mounted a rotatable feed mechanism 12 driven by an indexing mechanism 13. A plunger mechanism 14 and a cutting mechanism 16 are positioned about the periphery of apparatus 10. A vibrating conveyor 17 transports potatoes to an annular supply tray 18 rotatably mounted to frame 11.

As shown in FIG. 1, feed mechanism 12 includes a feed tab)e 19 mounted on a rotatable vertical shaft 21. Feed table 19 is of generally circular configuration and includes a plurality of open-bottomed feed cups 22 mounted in apertures about its periphery. The open lower ends of cups 22 are positioned immediately above an annular support plate 23 which is mounted to frame 11 and supported above the surface of a lower table 24 by a plurality of support legs 26.

As best illustrated in FIG. 2, a strip 27 of low friction plastic material is positioned beneath cups 22 and mounted to support plate 23 by a plurality of screws. A plurality of apertures 30 are suitably provided in support plate 23 and strip 27 such that the potatoes to be cut can be loaded into cutting system 16.

Referring again to FIGS. 1 and 3, indexing mechanism 13 is operated by a pneumatic drive cylinder 29 and a pneumatic locking cylinder 31. One end of drive cylinder 29 is mounted to frame 11 and the other is attached to the free end of a ratchet arm 32. The other end of ratchet arm 32 is pivotally mounted to shaft 21. A pawl 33 is pivotally mounted to ratchet arm 32 adjacent the attachment point of drive cylinder 29 and is spring biased into engagement with a ratchet wheel 36 which is, in turn, mounted on the shaft 21. A pair of limit switches 34, 35 are positioned, respectively, to close when cylinder 29 is in its fully retracted and extended positions. Extension of drive cylinder 29 thus results in rotation of arm 32, pawl 33, ratchet wheel 35 and drive shaft 21. Since feed table 24 is also attached to drive shaft 21, operation of drive cylinder 29 results in rotation of feed table 24. The length of arm 32 and stroke of cylinder 29 are chosen such that operation of cylinder 29 sufficiently moves table 24 to position the next set of cups 22 above the apertures 30 in support plate 23.

Figure 3:
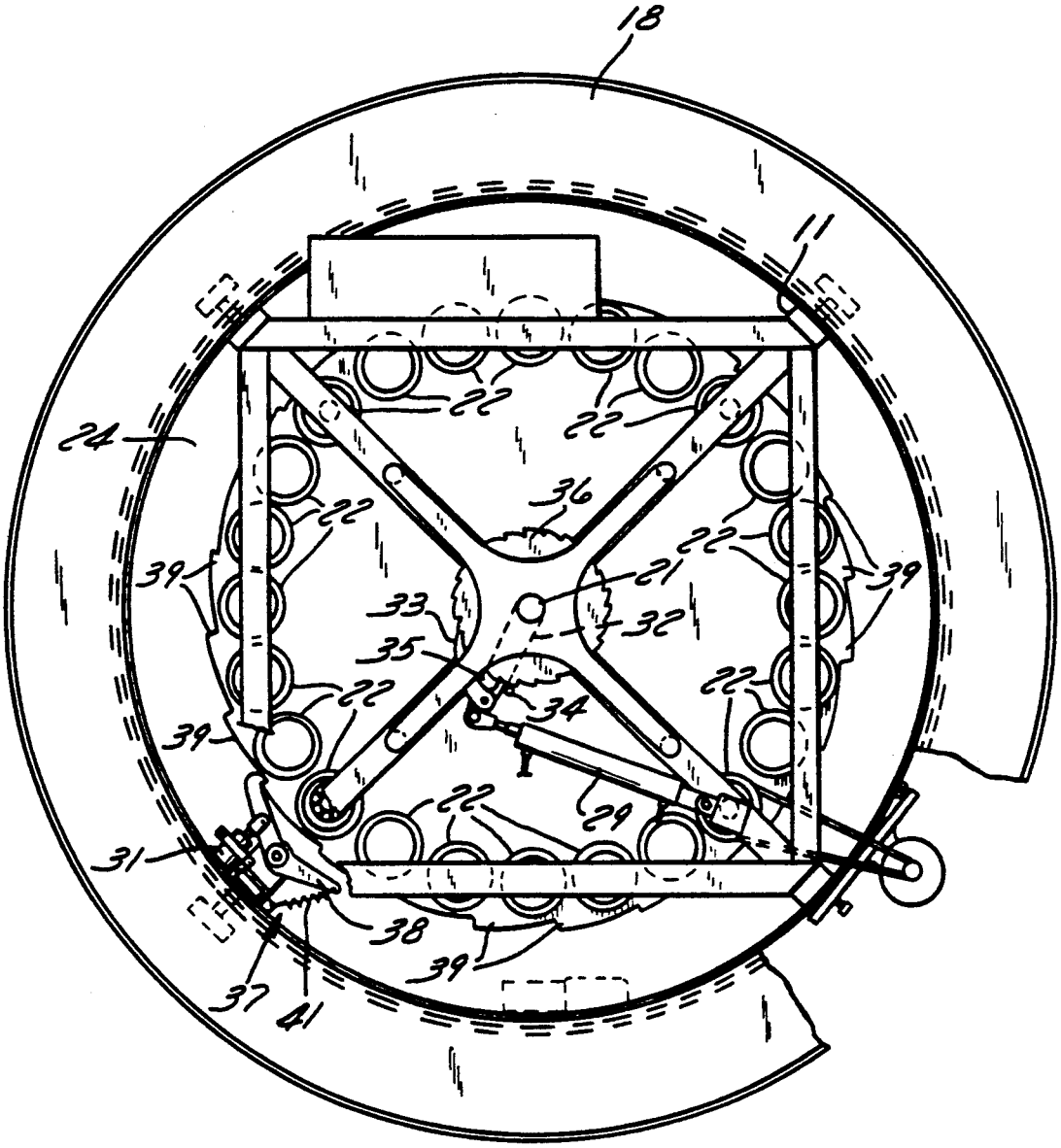
FIG. 3 is a top plan view of the cutting apparatus of FIG. 1 with parts broken away.

Referring next to FIGS. 1-3, the plunger mechanism 14 comprises four identical plunger units 42. Each plunger unit 42 includes a double acting pneumatic cylinder 43 mounted to the frame 11 by upper and lower brackets 44, 46. The plunger head 47 is mounted on the shaft of the pneumatic cylinder 43. A rod 48 is mounted to the plunger 47 and is slidably supported by the lower bracket 46 for vertical movement for the plunger head 47. Upper and lower limits switches 49, 51 are mounted on the upper and lower brackets 44, 46 in position for actuation by a tab 52 mounted on the free end of the rod 48, respectively, when the pneumatic cylinder is fully retracted or extended.

With continued reference to FIG. 1, plunger mechanism 14 comprises four identical plunger units 42. Each plunger unit 42 includes a double acting pneumatic cylinder 43 mounted to frame 11, such as by upper and lower brackets 44, 46. Plunger head 47 is mounted on the shaft of pneumatic cylinder 43. A rod 48 is mounted to plunger head 47 and is slidably supported by lower bracket 46 for vertical movement with plunger head 47. Upper and lower limit switches 49, 51 are mounted, respectively, on upper and lower brackets 44, 46 in position for actuation by a tab 52 mounted on the free end of rod 48, respectively, when pneumatic cylinder 43 is fully retracted or extended.

Referring more particularly to FIG. 2, plunger head 47 is formed with a plurality of grooves 53 extending longitudinally along the sides of plunger head 47. Grooves 53 cooperate with elements of cutting mechanism 16, as described below, to provide complete and accurate cutting of potatoes or other vegetables.

Cutting mechanism 16 preferably comprises four identical cutting units 56. As best shown in FIGS. 1 and 2, cutting units 56 include a holder 57, a rotatable cutting assembly 58, a support 59 for rotatably mounting the cutting mechanism to the table 24, and a drive unit 61 for rotatably driving cutting assembly 58.

Holder 57 receives and aligns potatoes for cutting and secures the potatoes against rotation during the cutting process. Referring more particularly to FIG. 2, holder 57 includes a tubular body 62 for receiving potatoes and is mounted on a base plate 71. A plurality of fingers 63 are hinged to body 62 adjacent the upper lip of body 62 and extend into body 62 through corresponding slots 64. The inner surface 66 of each finger 63 is blunt to prevent cutting of the potatoes held in body 62. In accordance with the illustrated embodiment of the invention, six fingers 63 are hinged to body 62.

A pin 68 is pivotally connected to each finger 63. Preferably, six pins corresponding to each of the six fingers 63 are employed. Each pin 68 extends through a corresponding slot 72 in a ring 69 and includes a head 73 which bears against the outer surface of ring 69 to limit inward travel of finger 63. A spring 67 is positioned about each pin 68 for independently biasing each corresponding finger 63 into the interior of body 62. The outer end of springs 67 bear against ring 69. Ring 69 is not mounted on base plate 71, but rather is free to float as each finger 63 moves upon positioning of a potato in holder 57, thus allowing holder 57 to accommodate and align even highly irregularly shaped potatoes within body 62.

As shown best in FIG. 2, a pair of nozzles 65 are mounted on base plate 71 for supplying rinse water to cutting assembly 58. Preferably, holder 57 is constructed such that ring 69 is mounted in a groove (not shown) in base plate 71, and a plurality of drain holes 75 are provided in base plate 71. In this manner, rinse water supplied to cutting assembly 58 is readily drained away.

Figure 4:
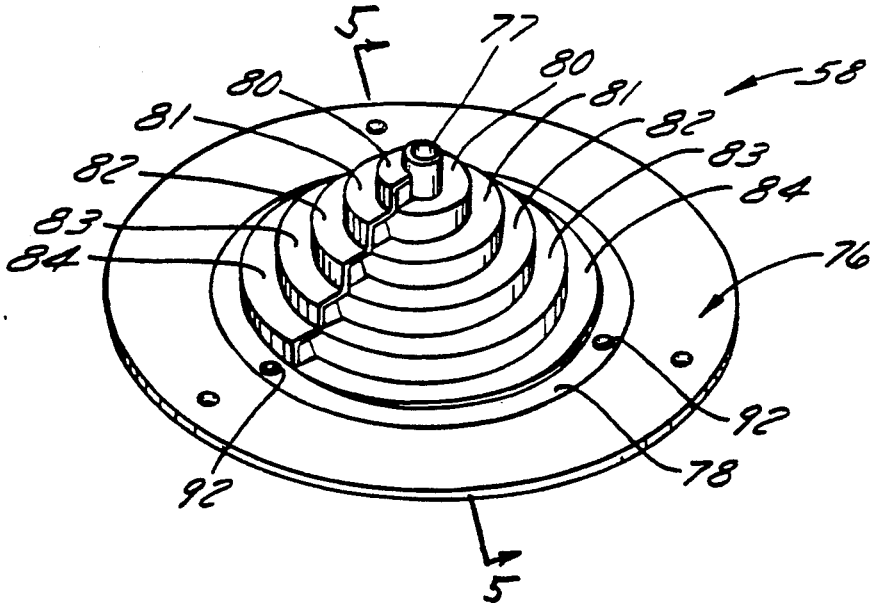
FIG. 4 is a perspective view of the cutting assembly according to the present invention.

As shown in FIGS. 2 and 4, cutting assembly 58 preferably includes a blade assembly 74 and a flanged mounting plate 76. A plurality of mounting holes 75 are provided about the periphery of plate 76 which correspond to a like plurality of mounting holes (not shown) on the cutter drive assembly 61 to receiver mounting means such as flush screws. Alternatively, the outer flange 95 of the mounting plate 76 may be threaded for mounting on the cutter drive assembly 61.

Figure 5:
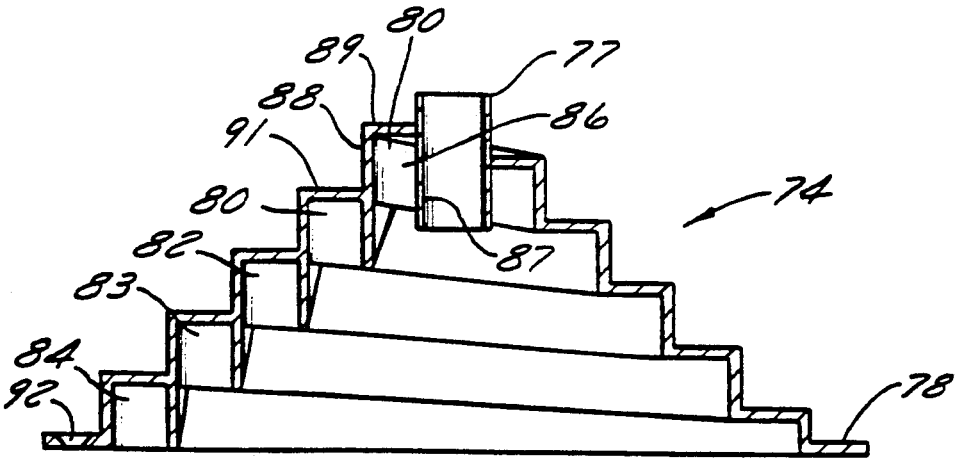
FIG. 5 is a cross-sectional view of the cutting assembly according to the present invention taken along line 5—5 of FIG. 4.

As shown best in FIGS. 4 and 5, blade assembly 74 has a generally spiroidal configuration. Blade assembly 74 includes a central cutting tube 77, a base plate 78 and a plurality of cutting tiers helically disposed therebetween. Preferably, blade assembly 74 comprises one or more tiers, and more preferably two or more tiers. In accordance with a preferred embodiment, five tiers 80, 81, 82, 83 and 84 form blade assembly 74. In accordance with the preferred embodiment of the present invention, each tier 80–84 is helically disposed about central cutting tube 77.

Each tier of blade assembly 74 includes at least one open cutting end 86. For example, as shown in FIGS. 4 and 5, tier 80 includes an open cutting end 86. Each tier also includes three walls. For example, tier 80 includes an inner side wall 87, an outer side wall 88 and a generally planar but inclined top wall 89. In accordance with a preferred embodiment of the invention, the open cutting ends of each tier are aligned with the cutting ends of the other tiers as illustrated best in FIG. 4.

With continued reference to FIGS. 4 and 5, tier 80 is helically wound downwardly about cutting tube 77 such that top wall 89 is below top 91 of tier 81. Preferably, the top walls of each of tiers 80–84 falls approximately 0.25 inches per 360° revolution (depending on the cross-sectional size of the desired final product). In this manner, when cutting assembly 58 including blade assembly 74 is used to cut potatoes or other vegetables, helical strips are formed and cut by each tier 80–84. The downward slope of each tier 80–84 causes the helically-cut strips of potato or other vegetable to pass through the interior of blade assembly 74 and be collected as hereinafter described.

Preferably, tiers 80–84 have a width of from about 0.2 to about 0.4 inches. More preferably for a helical potato of about 0.25 inch cross section, the width of tiers 80–84 is in the range of from about 0.23 to about 0.28 inches, and most preferably about 0.2750 inches. The height of each tier 80–84 is preferably in the range of about 0.2 to about 0.4 inches, and is most preferably about 0.250 inches for a 0.25 inch product. As noted above, the top wall of each tier, and thus the tier itself, is angularly aligned with respect to base plate 78 such that each tier rises about 0.250 inch over the helical path about central tube 77. It should be appreciated that these dimensions are illustrative for a helically cut potato strip having a cross-section of about 0.25 inch. These dimensions therefore may be appropriately increased or decreased, as desired, for resulting larger or smaller cross-section strips of helically cut potato.

Central cutting tube 77 is positioned interiorly of tiers 80–84 and is fixedly attached to tier 80. Preferably, the upper surface of tube 77 extends upward from top wall 89 of tier 80 to a position approximately 0.125 inch above top wall 89. Cutting tube 77 of blade assembly 74 may be cut off at an angle (not shown), and is sharpened about its periphery so that it not only penetrates the potato but actually cuts a cylindrical core from the center of the potato, the core being preferably in the range of about 0.3 to about 0.35 inch, and most preferably about 0.313 inch. In commercial use, this core should be quite small since it usually is separated from the helical cuts prior to further processing.

Cutting tube 77 is oriented such that the lowermost end of tube 77 extends below the top wall of the second horizontal tier blade 81. As such, breakage of the innermost helical strip cut by blade assembly 74 is minimized, since this strip has a radius approximately equal to the radius of the cutting tube 77. The presence of tube 77 tends to minimize damage and breakage of the spiral strips of potatoes as they are cut and eliminates crushing of any portion of the potato against the surface of the blade assembly 74.

The cutting portion of assembly 74 preferably has an overall diameter in the range of about 2.5 to about 3.5 inches, and most preferably about 3.0 inches. In this manner, even large potatoes can be easily cut into helical strips. For potatoes, or other vegetables that are smaller than the diameter of the cutting portion of blade assembly 74, only the uppermost tiers, e.g., tiers 80 and 81, would be used to cut the potato into helical strips.

Base plate 78 of blade assembly 74 includes a plurality of mounting holes 92 about its periphery which correspond to a plurality of holes 93 in the recessed interior flange 94 of mounting plate 76. Flush mounting screws (not shown) preferably are used to secure blade assembly 74 to mounting plate 76 and do not project from either the upper or lower surface of the cutting assembly 58.

Breakage of the helically-cut strips of vegetable is also reduced by the shape of the tier blades 80–84. The open ends of these blades extend vertically from the blade assembly 74 and travel in a circular path as the blade assembly is rotated. Preferably, the radius of curvature of each tier blade is approximately equal to the radius of the circular path traveled by such blade, advantageously reducing the tendency of the helical strips of potato to break during cutting and handling. Additionally, the downward inclination of each tier, described above, tends to force the helically-cut strips downward through apparatus 10 further preventing breakage.

Blade assembly 74 is preferably made by machining a stainless steel preform, and thereafter, cutting tube 77 is drilled such that open top and bottom ends are obtained.

With reference to FIG. 2, cutter drive assembly 61 includes a drive tube 96 which is rotatably supported in the cutter support housing 59 by upper and lower ball bearings (not shown). The upper end of drive tube 96 is threaded to receive cutting assembly 58 and a seal 9 is positioned between support housing 59 and drive tube 86 to seal out water from the nozzles 65. Drive tube 96 is preferably driven by an electric motor and pulley arrangement, known to those skilled in the art. Cutter housing 59 and holder 57 are both mounted to table 24.

Spray shield 102 is mounted to frame 11 and encircles the lower end of drive tube 96. A tubular chute 100 is mounted to spray shield 102 and extends upwardly into drive tube 96 to a position just beneath cutting assembly 58. Chute 100 conducts the helically-cut potato strips and rinse water away from cutting assembly 58, and prevents contact between the helically-cut potato strips and the rotating drive tube which otherwise could result in the strips being held against the walls of the tube by centrifugal force. Any water which leaks between drive tube 96 and chute 100 drains to the bottom of drive tube 96 and is caught by spray shield 102 and drains out through holes 104 in the bottom of shield 102. The helically-cut potato strips may be collected in hoppers (not shown) located proximate apparatus 10.

In operation, potatoes are transported to annular conveyor 18 by a vibrating conveyor 19. Workers are positioned about the periphery of the machine to take potatoes from conveyor 18 and insert them into cups 22 mounted on feed table 19. Alternatively, the loading of potatoes into feed caps 22 may be automated, as is known in the art and is described in the '838 patent. Apparatus 10 is then activated. Pneumatic cylinders 43, originally in their retracted position, once energized, are extended, causing plunger head 47 to extend and push a potato from cup 22 into holder 57. Fingers 63 and holder 57 are pushed outward as potatoes enter tubular body 62 and grip the potatoes by their sides, aligning them vertically and holding them against rotation.

The downward stroke of cylinders 43 force the potatoes into contact with rotating cutting assemblies 58. The novel blade assembly 74 of the present invention then cuts the potato into helical strips. The cutting continues until cutting tube 77 reaches plunger head 47. As plunger head 47 moves downward through holder 57, vertical grooves 53 in plunger head 47 receive fingers 63. Grooves 53 are of a sufficient depth to avoid interference with finger 63, which must continue to hold the potato against rotation throughout the entire downward stroke of cylinder 43. As tier blades 80–84 cut the potato into helical strips, a cylindrical core is also cut also from the potato by cutting tube 77.

The operation of cutting apparatus 10 may be advantageously monitored and controlled by a conventional programmable controller, such as is discussed in the '838 patent. It will be understood that the above description is of a preferred exemplary embodiment of the invention, and that the invention is not limited to the specific forms shown. For example, different numbers of tiers may be used to form the blade assembly. Moreover, the blade assembly is useful in cutting apparatus distinct from that shown herein, as is known or is hereafter devised by those of ordinary skill in the art. Various other substitutions, modifications, changes and omissions may be made in the design and arrangement of the elements of the invention without departing from the scope of the invention as expressed in the appended claims.

I claim:

1. An apparatus for cutting articles into helical strips, said apparatus including means for aligning an article to be cut into helical strips, and a rotary cutter mounted adjacent the aligning means, the cutter including a blade assembly having a rotational axis and comprising a base plate and a plurality of stacked, helical and sloped tier blades, a first tier blade being disposed about a rotational axis and each successive tier blade being located radially outwardly and axially offset from the preceding tier blade, each tier blade including a leading open cutting end defined in part by a pair of cutting walls arranged perpendicularly to one another.

2. The apparatus of claim 1, wherein each tier blade extends about 360° around the axis.

3. The apparatus of claim 1, wherein the blade assembly comprises three or more of the tier blades.

4. The apparatus of claim 1, wherein the blade assembly further including a generally cylindrical, axially disposed cutting tube.

5. The apparatus of claim 1, wherein the trailing end of each tier blade generally adjoins the open cutting end of an adjacent radially spaced tier blade.

6. The apparatus of claim 1, wherein the pair of cutting walls at each cutting end includes an outer side wall and a generally planar, but sloped top wall, the top wall of each tier blade being sloped approximately 0.25 inches along its length, each cutting end further comprising an inner side wall arranged generally perpendicular to the top wall.

7. The apparatus of claim 1, wherein each of the tier blades has a width in the range of from about 0.2 to about 0.4 inches and a height of about 0.2 to about 0.4 inches.

8. An apparatus for cutting food articles into helical strips comprising a holder having a longitudinal passage and means for holding a food article in the holder against rotation;

a rotary cutting assembly mounted adjacent the holder and including a blade assembly oriented to cut an article into a plurality of helical strips as a held article is pushed through the passage, the blade assembly including a plurality of helical and sloped tier blades, a first tier blade being disposed about a rotational axis and each successive tier blade being located radially outwardly and axially offset from the preceding tier blade, each tier blade including an open cutting end defined in part by a pair of cutting walls arranged perpendicularly to one another.

9. The apparatus of claim 8, wherein the blade assembly further includes a generally cylindrical, axially disposed cutting tube.

10. An apparatus for cutting food articles into helical strips comprising:

a holder for holding a food article, the holder having a longitudinal passage;

distributor for transferring food articles to the holder;

an article feeder associated with the holder, the article feeder including means for pushing articles through the passage;

article holding means for aligning and preventing articles within said passage from rotating while the article is being cut; and a rotary cutter mounted adjacent the holder and having a rotational axis, the rotary cutter including a blade assembly having a plurality of stacked, helical and sloped tier blades, a first tier blade being disposed about the rotational axis and each successive tier blade being located radially outwardly and axially offset from the preceding tier blade, each tier blade including an open cutting end defined in part by a pair of cutting walls arranged perpendicularly to one another.

11. The apparatus of claim 10, wherein the blade assembly includes a generally cylindrical, axially aligned cutting tube and a base plate, the plurality of tier blades being disposed therebetween.

12. A cutting assembly having a rotational axis comprising a plurality of stacked, helical and sloped tier blades, a first tier blade being disposed about the rotational axis and each successive tier blade being located radially outwardly and axially offset from the preceding tier blade, each tier blade including at least one open cutting end defined in part by a pair of cutting walls arranged perpendicularly to one another.

13. The cutting assembly of claim 12, wherein the plurality of tier blades comprises three or more of the tier blades.

14. The cutting assembly of claim 12, wherein each tier blade generally extends 360 degrees about the axis.

15. The cutting assembly of claim 12, wherein each tier blade has a width in the range of about 0.2 to about 0.4 inches and a height of about 0.2 to about 0.4 inches.

16. The cutting assembly of claim 12, wherein each tier blade extends about 360° around the axis.

* * * * *